United States Patent [19]

Best

[11] 4,207,456

[45] Jun. 10, 1980

[54] ELECTRICAL INFRARED RADIANT HEATER

[76] Inventor: Willie H. Best, P.O. Box 868, Columbia, S.C. 29202

[21] Appl. No.: 848,508

[22] Filed: Nov. 4, 1977

[51] Int. Cl.[2] ..... H05B 3/00

[52] U.S. Cl. ..... 219/345; 219/354; 219/460; 219/464; 219/531; 338/234; 338/235; 338/295

[58] Field of Search ..... 338/234, 236, 252, 276, 338/290, 295, 305, 310, 311, 307, 321, 53, 55, 57, 58; 219/345, 352, 353–355, 374, 381, 382, 254, 255, 258, 445, 455, 457, 462, 464–467, 531, 460, 544

[56] References Cited

U.S. PATENT DOCUMENTS

| | | | |
|---|---|---|---|
| 1,255,326 | 2/1918 | Macnicol | 338/252 |
| 2,481,760 | 9/1949 | Leher | 219/381 |
| 3,541,305 | 11/1970 | Kuwayama et al. | 219/345 |
| 3,781,527 | 12/1973 | Tymzcak | 219/464 |

FOREIGN PATENT DOCUMENTS

| | | | |
|---|---|---|---|
| 119540 | 8/1943 | Australia | 219/258 |
| 480320 | 4/1916 | France | 219/467 |
| 2265244 | 10/1975 | France | 219/544 |
| 331237 | 6/1930 | United Kingdom | 219/345 |
| 499074 | 1/1939 | United Kingdom | 219/382 |

*Primary Examiner*—B. A. Reynolds
*Assistant Examiner*—Bernard Roskoski
*Attorney, Agent, or Firm*—Newton, Hopkins & Ormsby

[57] ABSTRACT

An electrical infrared radiant heater in which a heater assembly includes an extruded ceramic holder having parallel holes, certain of which receive heating element wires through such holes. The ends of the heating element wires extend outwardly of the holder on both sides and are joined to each other so as to form a resistance element connected to a source of current. A casing carries the heater assembly.

4 Claims, 5 Drawing Figures

ELECTRICAL INFRARED RADIANT HEATER

BACKGROUND OF THE INVENTION

1. Field of the Invention

This invention relates to an electrical infrared radiant heater and to a process for producing the same.

2. Description of the Prior Art

In the past, electrical infrared radiant heaters have been extensively produced. Most of these heaters have employed coiled wires which are disposed adjacent the surface of a ceramic radiant element. The coiling of the wire is usually deemed necessary to provide sufficient resistance to generate the amount of heat desired. The radiant element which is disposed rearwardly adjacent to the coils of wire are for the purpose of being heated so as to radiate infrared heat in a forwardly direction back through the coils. The coils of wire are expensive to manufacture, often become damaged or broken, and successive convolutions of the coils direct their heat against each other rather than in the direction of the space or items to be heated. Furthermore, the radiant elements, which operate in conjunction with these coils are relatively inefficient in that the heat must be directed through the coils, toward the object or space to be heated. Such prior art infrared burners also usually require some shield or protective element to prevent damage to the coils.

SUMMARY OF THE INVENTION

Briefly described, the present invention, which overcomes the disadvantaged described above, includes an electrical infrared radiant heater which has a heater assembly formed from an extruded dielectric ceramic holder. The holder is provided with parallel closely adjacent holes throughout the length of the holder. Pairs of these holes, adjacent the front surface of the holder in a first row of holes, receive U-shaped heating element wires inserted from one end, therethrough. The free ends of these wires protrude from the other end of the holder and are joined together to provide a resistance element, connected to a source of electrical current. The unfilled holes in rows rearwardly of the front row, provide cells for insulating purposes. The heater assembly is carried in an appropriate housing and connected to a source of electricity.

Accordingly, it is an object of the present invention to provide an infrared radiant heater which is inexpensive to manufacture, durable in structure and efficient in operation.

Another object of the present invention is to provide an electrical infrared radiant heater in which the heating element wires are protected from damage.

Another object of the present invention is to provide an electrical infrared radiant heater which can be mass produced and which lends itself well to any preselected shape.

Another object of the present invention is to provide an inexpensive process for producing a superior infrared radiant heater.

Other objects, features and advantages of the present invention will become apparent from the following description when taken in conjunction with the accompanying drawings wherein like characters of reference designate corresponding parts throughout the several views.

DETAILED DESCRIPTION

Figure 1:
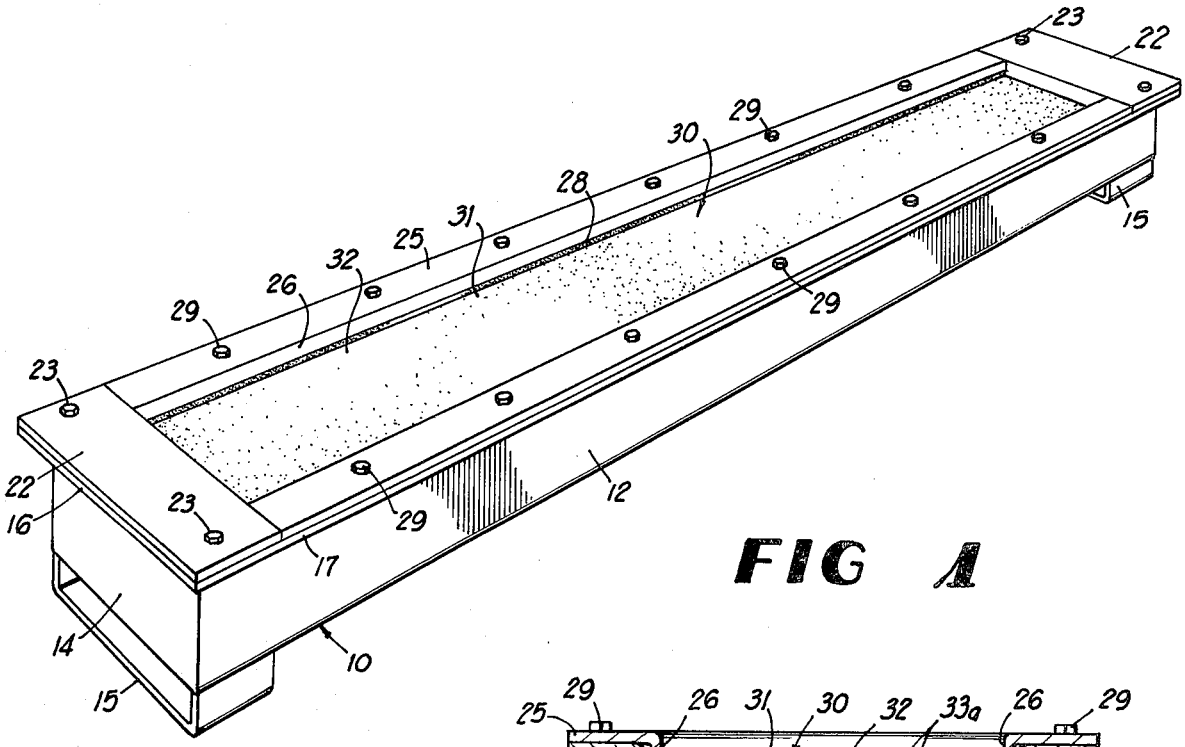
FIG. 1 is a perspective view of an electrical infrared radiant heater constructed in accordance with the present invention.

Referring now in detail to the embodiment chosen for the purpose of illustrating the present invention, numeral 10 denotes generally a housing which is provided with a flat rectangular bottom 11, a pair of opposed longitudinally extending parallel side walls 12, and a pair of opposed parallel transversely extending end walls 14, joining the ends of side walls 12. Suitable means for mounting the housing 10 are provided, such as the U-shaped brackets 15 which are secured to the bottom 11 at its opposite ends. The upper ends of the end walls 14 are turned outwardly to provide end flanges 16. The upper ends of the side walls 12 are also turned outwardly to provide flanges 17. The flanges 16 and 17 are disposed in a common plane parallel to and spaced from the plane of bottom 11 and form a perimeter panel around the open front side of housing 10.

Within the cavity formed by the housing 10 and extending along the inside surfaces of the walls 12 are a pair of opposed brackets 20. The brackets 20 are each angle irons, one flange of which is fixed flush against the inside surface of the wall 12 and the other flange of which protrudes inwardly from the upper end of the first flange. Thus, opposed parallel ledges are formed by the brackets 20 in a plane inwardly parallel to flanges 16 and 17, for receiving the heater assembly denoted generally by numeral 30. Inwardly of the end walls 14 and joining the ends of the brackets 20 are a pair of opposed parallel transversely extending receiving brackets 21, seen best in FIG. 3. Upstanding lips on the brackets 21 are for the purpose of arresting longitudinal movement of a heater assembly 30 while the sides or walls 12, above the brackets 20, arrest transverse movement of the heater assembly 30.

The heater assembly 30 includes an extruded dielectric ceramic holder 31 which is a right prismatic rectangular element removably received on the brackets 20 and 21. The holder 31 is of a width approximately equal to or slightly less than the width of the cavity of the housing 10 and of a length substantially shorter than the length of the housing 10, but approximately equal to or slightly less than the distance between the lips of the brackets 21. The thickness of the holder 21 is preferably greater than the distance between the brackets 20 and the plane of the flanges 16 and 17 so that, when the holder 31 is received on the brackets 20 and 21, the upper surface 32 of the holder 31 will be spaced inwardly of the plane of the flanges 16 and 17.

Rectangular, transversely extending end plates 22 are disposed over the flanges 16, respectively, and also extend over the outer end portions of the flanges 17. These end plates 22 are bolted by means of bolts 23 to the flanges 17. The inner ends of the plates 22 turn inwardly to provide abutment shoulders 24 which abut against the ends 33 of the holder 31. Side base plates 25 are secured along the surfaces of the flanges 17 and protrude inwardly therefrom, being provided with downwardly turned lips or shoulders 26. Beneath the shoulders 26 are resilient bumpers 28 which extend along opposite upper longitudinal edges of the holder 31 throughout the length of the holder 31. The flanges 26 retain the bumpers 28 in place while the bumpers 28 arrest any appreciable outward movement of the holder 31. Bolts 29 and nuts 29*a* retain the plates 25 on the flanges 17.

Figure 2:
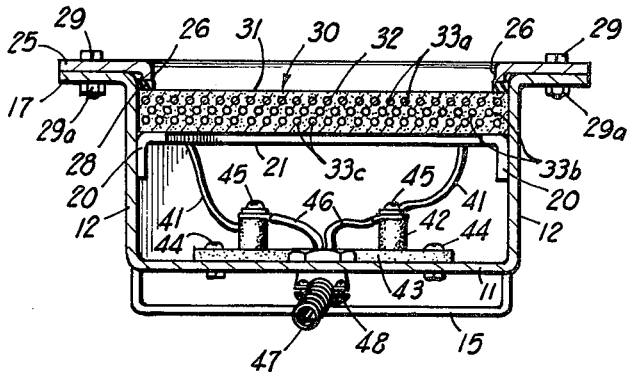
FIG. 2 is a cross-sectional view of the electrical infrared radiant heater disclosed in FIG. 1.

According to the present invention, the holder 31 is an extruded ceramic radiant element formed of any suitable refractory material, such as a clay, which has been fired to a temperature in excess of the operating temperature of the holder. The clay, while in a plastic condition prior to being cured has been extruded from an extruder so as to provide a uniform monolithic body of rectangular cross-sectional shape as depicted in FIG. 2 and to also provide a plurality of cylindrical longitudinally extending holes, such as holes 33*a*,33*b* and 33*c*. The axes of holes 33*a* are equally spaced from each other in a transversely extending first row and are disposed in a common plane immediately below the outer surface 32 of the holder 31, the holes 33*a* being closely adjacent to each other and their axes being in a plane parallel to the plane of the bottom 11. The holes 33*b* in the second row are staggered with respect to the holes 33*a* and their axes are in a plane parallel to the plane of the axes of the holes 33*a*. In like fashion, the holes 33*c* are disposed below the holes 33*b* and are offset or in staggered relationship to holes 33*b*, the axes of the holes 33*c* being in a plane parallel to the planes of the axes of the holes 33*a* and 33*b*.

When viewed in cross-section, as seen in FIG. 2, respective holes 33*a*, 33*b* and 33*c* are aligned along straight angular extending spaced parallel lines so that holes in alternate rows are vertically aligned.

Figure 5:
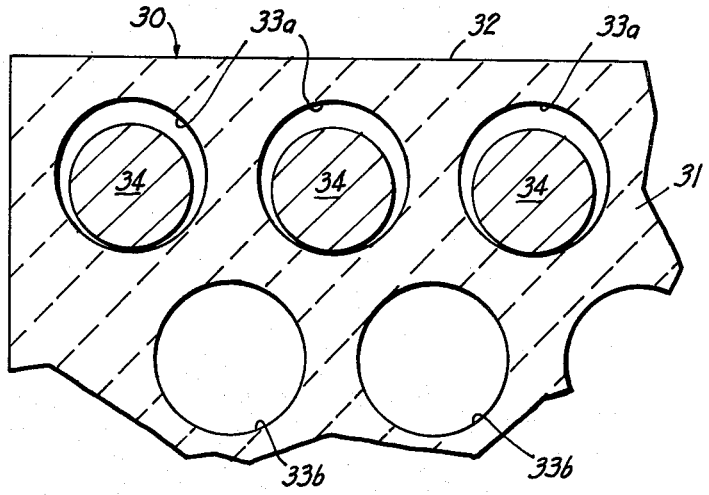
FIG. 5 is an enlarged fragmentary vertical sectional view of a portion of the heater assembly shown in FIG. 4.

Usually it is preferable to form approximately six (6) or seven (7) rows of holes, such as the holes 33*a* , 33*b* and 33*c*, each row being below the next adjacent row and all holes being parallel to each other. Thus a longitudinally open honeycomb of holes are provided in the holder 31. While it is preferable that all holes 33*a*, 33*b* and 33*c* be of approximately the same diameter, nevertheless, the holes 33*a* should be of a diameter slightly larger than the diameter of the electrical resistance wires 34 which are passed through the holes 33*a*, as depicted in FIG. 5. The holes 33*b*, 33*c* and any subsequent holes therebelow, can be larger or smaller than the holes 33*a*, as desired.

In more detail, the heating element, denoted generally by the numeral 35, is formed by a plurality of U-shaped electrical heating wires 36 having pairs of leg wires 34 joined by a U-shaped portion or base 37. The wires 34 are disposed parallel to each other and their axes are spaced apart by a distance equal to the distance between the axes of adjacent parallel holes 33*a*. Hence, a U-shaped wire section 36 can be readily received in the holder 31 by the insertion of its leg wires 34 through an adjacent pair of holes 33*a*. The leg wires 34 are longer than the length of the holder 31 from one end 38*a* to the other end 38*b*. Thus, each pair of wires or legs 34 protrude outwardly of one end 38*b* while the U-shaped connector base 37 thereof is outwardly of the other end 38*a*.

Figure 4:
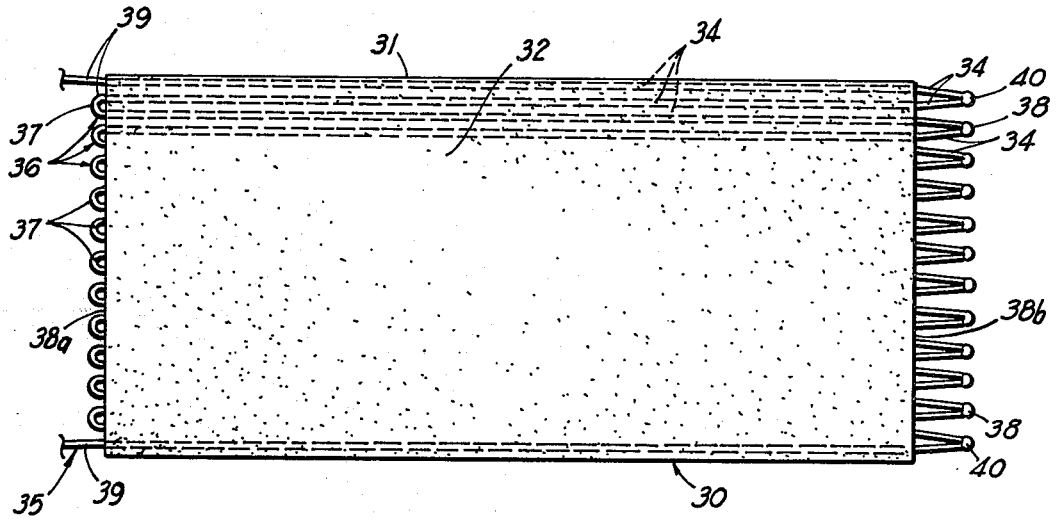
FIG. 4 is a plan view of the heater assembly of the heater shown in FIGS. 1, 2 and 3.

As best seen in FIG. 4, the ends or end portions of adjacent leg wires 34 of the U-shaped wires 36 are joined together by an appropriate junction means or joints 28 which are formed by resistance welding, braising, silver soldering or twisting the wires together. Thus, the wires 36 are arranged electrically in series. If desired, the end of leg wires 34 could be joined electrically in parallel, without departing from the scope of this invention.

Figure 3:
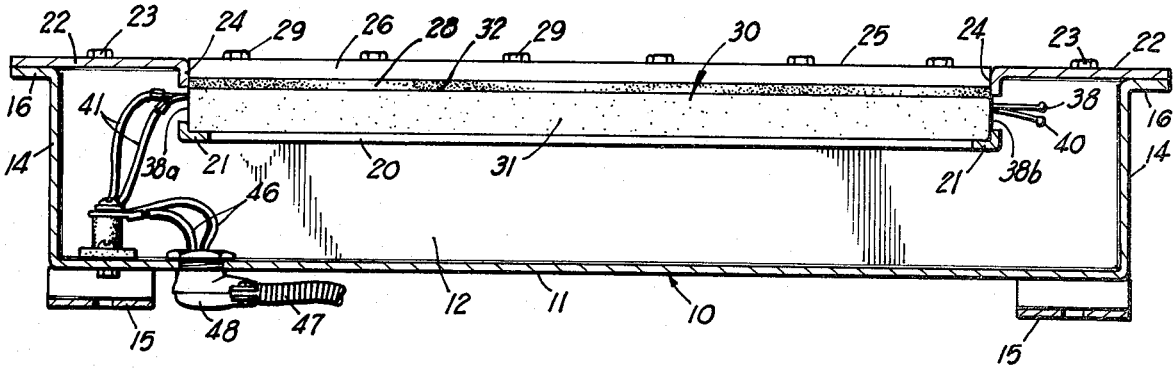
FIG. 3 is a vertical sectional view of the electrical infrared radiant heater depicted in FIGS. 1 and 2.

In the embodiment of FIG. 4, a pair of outer straight electric heating wires 39, similar to wires 34, are provided from a source of electricity through the outer holes 33*a* and are respectively connected by junction means joints 40 to the next adjacent leg wires 34. The ends of the wires 39 are electrically connected to wires 41 which lead to insulated upstanding posts 42 carried by a plate 43 mounted on the inside surface of the bottom 11 by means of bolts 44. Screws or bolts 45, which are threadedly receive in the ends of the post 42, connect the ends of wires 41 with the wires 46 which lead through an armoured cable 47 and a junction 48 into the housing 10, as depicted in FIGS. 2 and 3.

When electrical current is supplied through the wires 46 to the wires 41 and, thence, to the wires 39, a circuit is made so as to energize the heating element 35. The U-shaped wires 36 are connected in series by means of the junctions 38 and 40, and hence, the wires 34 are heated up to become red hot. The heating of the wires or legs 34 within the holes 33*a* heat that portion of the holder 31 which is between the surface 32 and the holes 33*a*, while in the area of the holes 33*b*, 33*c*, etc. the holder 30 remains, relatively cool. Hence, a vast majority of the heat radiating from the leg wires 34 will be directed toward heating the surface area adjacent to surface 32 to thereby radiate infrared heat outwardly of the radiant heater.

A relatively small amount of heat generated in the leg wires 34 are directed inwardly and hence, the present radiant burner is quite efficient in the utilization of electricity.

It is understood, of course, while I have illustrated that the holder 31 has a flat uniform outer surface 32 adjacent to the legs 34, nevertheless, the holder 31 may be extruded in any prescribed shape so as to conform to the contour of any object which is to be heated. Furthermore, if desired, the surface 32 may be provided with spaced parallel grooves and flat angularly disposed surfaces forming the grooves, so as to increase the radiation area of surface 32. Numerous other modifications in the shape of the holder 31 can be accomplished quite readily and easily with inexpensive extrusion dies.

The heater assembly 30 is quite readily adapted to mass production in that the wires 36 may be bent mechanically and inserted mechanically through the holes 33*a*. Also, the wires 34, outwardly of the end 33, can be bent alternately down so as to retain the wires firmly in position in the holder 31. The joining of adjacent leg wires 34 as at junctions 38 can be accomplished simultaneously and automatically through electrical resistance welding. Hence, such heater assemblies 30 are quite inexpensive to produce and require little manual labor.

It will be obvious to those skilled in the art that many variations may be made in the embodiment here chosen for the purpose of illustrating the present invention and full resort may be had to the doctrine of equivalents without departing from the scope thereof, as defined by the claims.

I claim:

1. An electrical infrared radiant heater comprising a heater assembly consisting essentially of an extruded dielectric refractory clay ceramic holder having a heat radiating surface said holder being provided with a plurality of first through holes disposed closely adjacent to each other in a first row immediately below said heat radiating surface of said holder and extending throughout the length of said holder, heating element wires extending axially through said first through holes, the diameter of said wires being slightly less than the diameter of said first through holes for substantially filling said first through holes said heating element wires being joined to provide an electrical resistance element, said wires in said first through holes and said heat radiating first through holes themselves being sufficiently close to said heat radiating surface that said wires heat said heat radiating surface to an infrared radiating condition when electricity is passed through said wires and means for connecting said electrical resistance element to a source of electricity, said holder being provided with a plurality of second through holes arranged in a second row said second through holes being unobstructed, whereby said unobstructed holes provide cells for insulating purposes said first row being between said second row and said radiating surface, said first row and said second row being disposed adjacent to each other and parallel to each other.

2. The heater defined in claim 1 wherein said first holes and said second holes are straight holes extending parallel to each other throughout the length of said holder.

3. The heater defined in claim 2 wherein said holder is provided with additional rows of holes below and parallel to said first holes, and all holes are parallel to each other to provide a honeycomb throughout said holder.

4. The heater defined in claim 2 wherein said first row of holes are open at their ends and pairs of said wires are integrally joined together outwardly of said first holes, junction means for connecting one of the wires of each pair of wires to one of the wires of the next adjacent pair of wires at the other end of said holder.

* * * * *